US006886708B2

(12) United States Patent
Kaufman et al.

(10) Patent No.: US 6,886,708 B2
(45) Date of Patent: May 3, 2005

(54) TAMPER-EVIDENT OVERCAP

(75) Inventors: Brett Kaufman, Newburgh, IN (US); D. Todd Faubion, Evansville, IN (US); Chris A. Dewig, Evansville, IN (US)

(73) Assignee: Berry Plastics Corporation, Evansville, IN (US)

( * ) Notice: Subject to any disclaimer, the term of this patent is extended or adjusted under 35 U.S.C. 154(b) by 0 days.

(21) Appl. No.: 10/357,846

(22) Filed: Feb. 4, 2003

(65) Prior Publication Data

US 2004/0149756 A1 Aug. 5, 2004

(51) Int. Cl.[7] ..... B65D 51/20
(52) U.S. Cl. ..... 220/257.1; 220/265
(58) Field of Search ..... 220/257.1, 264–266, 220/375, 276, 254, 915, 281, 784, 258.5, 169, 270; 215/256; 222/541.9, 541.4, 541.5, 541.6; 250/250–257

(56) References Cited

U.S. PATENT DOCUMENTS 1,326,885 A * 12/1919 Wales ..... 220/281
3,128,004 A 4/1964 Soffer
3,170,603 A 2/1965 Kitterman
3,180,532 A 4/1965 Michel
3,850,329 A * 11/1974 Robinson ..... 215/254
3,885,715 A 5/1975 Lowry
3,927,796 A 12/1975 Whitehouse
4,322,010 A 3/1982 Curry
4,738,375 A * 4/1988 Rosen et al. ..... 220/276
4,934,557 A 6/1990 Smith
4,962,864 A 10/1990 Appal et al.
5,085,333 A 2/1992 Dutt et al.
5,337,912 A 8/1994 Jochem
5,617,968 A * 4/1997 Luburic ..... 220/276
5,642,825 A * 7/1997 Wohlgemuth ..... 215/256
5,722,568 A 3/1998 Smith
5,775,528 A * 7/1998 Wohlgemuth et al. ..... 215/256
6,070,765 A * 6/2000 Holzboog ..... 222/153.06
6,644,491 B2 * 11/2003 Dewig et al. ..... 220/276

* cited by examiner

*Primary Examiner*—Lien Ngo
(74) *Attorney, Agent, or Firm*—Barnes & Thornburg LLP

(57) ABSTRACT

An overcap includes a closure and a tear strip. The closure includes two "permanent" retainer flanges adapted to engage an underside of an annular lip included in a can and arranged to surround a dispenser nozzle. The tear strip includes two "temporary" retainer flanges adapted to engage the underside of the annular lip to help retain the overcap on the can until the tear strip is separated from the closure.

28 Claims, 4 Drawing Sheets

TAMPER-EVIDENT OVERCAP

BACKGROUND AND SUMMARY

The present disclosure relates to overcaps for mounting on the top of cans or containers. More particularly, the present disclosure relates to a tamper-evident overcap having a tear strip that must be removed before the overcap can be removed from the can or container.

Overcaps provide a protective covering for a dispensing device (e.g., push-to-spray button, discharge nozzle, etc.) positioned on the can or container. To remove the contents of the can or container, the cap is removed and the dispensing device is activated. Such overcaps are typically formed in a mold using a plastics material such as polypropylene or high-density polyethylene.

The cans or containers are stored in warehouses and later displayed on store shelves for purchase by consumers. During the time period when the cans or containers are stored and displayed, they may be accessible to people who wish to tamper with them. It is known to provide a tear strip that is appended to a bottom portion of the overcap. If the tear strip is missing when the consumer purchases the product, then the consumer is put on notice that the can or container may have been tampered with. After the tear strip is removed from the overcap, a remaining closure portion of the overcap is used to cover the can or container.

According to the present disclosure, a tamper-evident overcap is provided for mounting on a can having a dispenser valve and an annular lip surrounding the dispenser valve. The overcap includes a closure and a tear strip appended to the closure along a frangible tear line.

The tear strip includes, in series, a pull tab, a first arcuate section carrying a first retainer flange, a tether section, and a second arcuate section carrying a second retainer flange. The closure includes a base having a second curved wall carrying a third retainer flange and a first curved wall carrying a fourth retainer flange. The tether section is spaced-apart from the second curved wall yet is arranged to interconnect the first and second arcuate sections. Thus, the pull tab can be used to separate, in sequence, the first and second arcuate sections (carrying the first and second retainer flanges) from the base of the closure without disturbing the first and second curved walls (carrying the third and fourth retainer flanges).

Prior to separation of the tear strip from the closure, when the overcap is mounted on the can, each of the first, second, third, and fourth retainer flanges engages the underside of the annular lip on the can to retain the overcap in a mounted position on the can. Thus, all four retainer flanges will engage the annular lip as long as the tear strip remains coupled to the base of the closure.

Before a user removes the overcap from the can for the first time, the user will use the pull tab to separate the tear strip from the closure along the frangible tear line to disengage the first and second retainer flanges from the annular lip. At this stage, only the third and fourth retainer flanges provided on the closure engage the annular lip on the can to retain the overcap in a mounted position on the can. Thereafter, only the third and fourth retainer flanges provided on the closure will be used to retain the overcap in the mounted position on the can. Thus, the first and second retainer flanges on the tear strip are called "temporary" retainer flanges herein because they do not remain with the closure after separation of the tear strip from the closure. The third and fourth retainer flanges on the closure are called "permanent" retainer flanges herein because they remain with the closure after separation of the tear strip from the closure.

Additional features of the disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which:

FIG. 8 is a sectional view similar to FIG. 7 showing separation of the pull tab and the first arcuate section from the closure base and disengagement of the first retainer flange from the annular lip on the aerosol can;

FIG. 9 is a sectional view similar to FIG. 8 showing partial separation of the second arcuate section from the closure base and partial disengagement of the second retainer flange from the annular lip of the aerosol can;

FIG. 10 is a sectional view similar to FIGS. 8 and 9 showing final separation of the tear strip from the closure base and retention of the overcap on the annular lip of the aerosol can using only the third and fourth retainer flanges (in phantom) included in the closure base;

DETAILED DESCRIPTION

Figure 1:
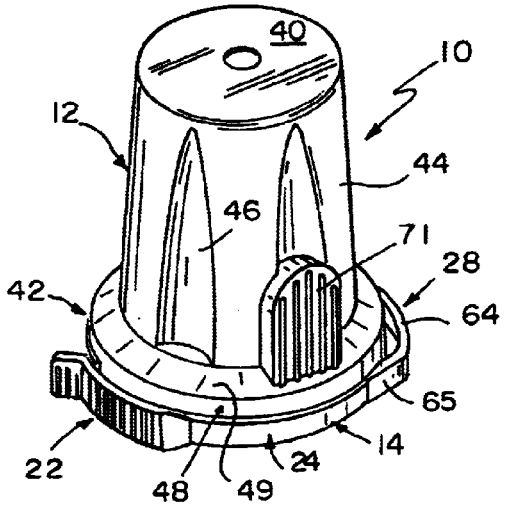
FIG. 1 is a perspective view of a tamper-evident overcap configured to be mounted on an aerosol can as shown in FIG. 4, the overcap including a closure having a circular top and an annular side extending downwardly from the circular top toward a base and a removable, annular tear strip appended to and encircling the base of the closure.
Figure 2:
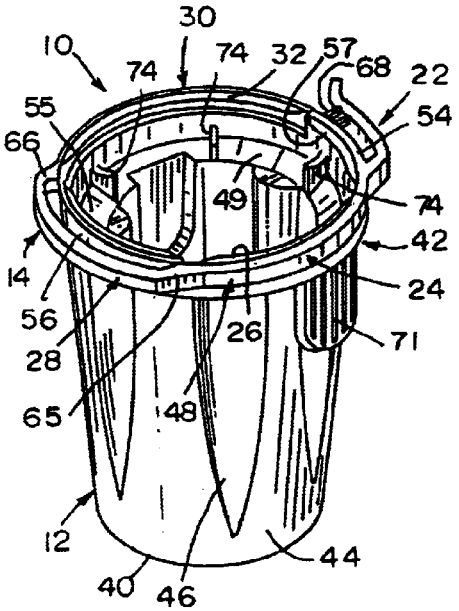
FIG. 2 is a perspective view of the "inverted" overcap of FIG. 1 showing the annular tear strip (including its pull tab) in more detail.
Figure 3:
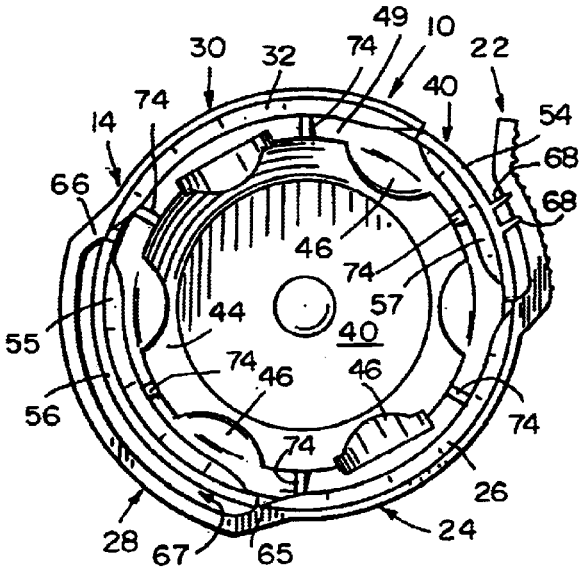
FIG. 3 is a top plan view of the inverted overcap of FIG. 2 showing that the annular tear strip includes, in series (in a clockwise direction beginning at 2:00 'o'clock), a pull tab, a first arcuate section carrying a curved first retainer flange, a U-shaped tether section spaced from the base of the closure, and a second arcuate section carrying a curved second retainer flange.

A tamper-evident overcap 10 including a closure 12 and an annular tear strip 14 is shown in FIGS. 1–3. Overcap 10 is configured to mount on a can 16 (or other suitable container) having a dispenser valve 18 and an annular lip 20 surrounding dispenser valve 18 as shown, for example, in FIGS. 5–7.

Figure 8:
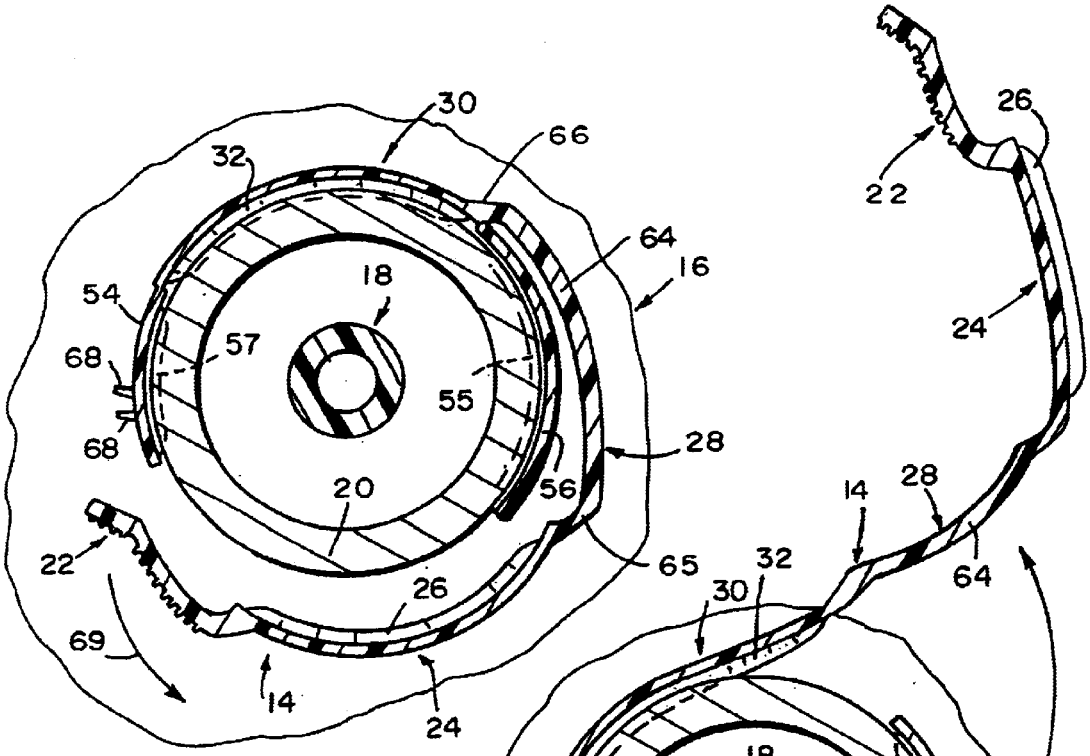
FIGS. 8–10 show a series of steps in which the annular tear strip is pulled manually using a counterclockwise pulling motion to separate the annular tear strip from the base of the closure so that the first and second retainer flanges included in the tear strip are disengaged from the annular lip of the aerosol can after separation of the tear strip from the closure base causing only the third and fourth retainer flanges included in the base of the closure to engage the underside of the annular lip to retain the overcap in place on the aerosol can.
Figure 9:
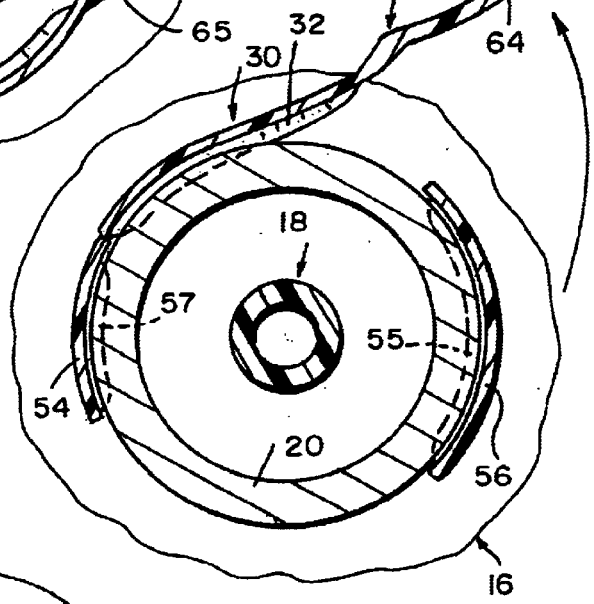
Figure 10:
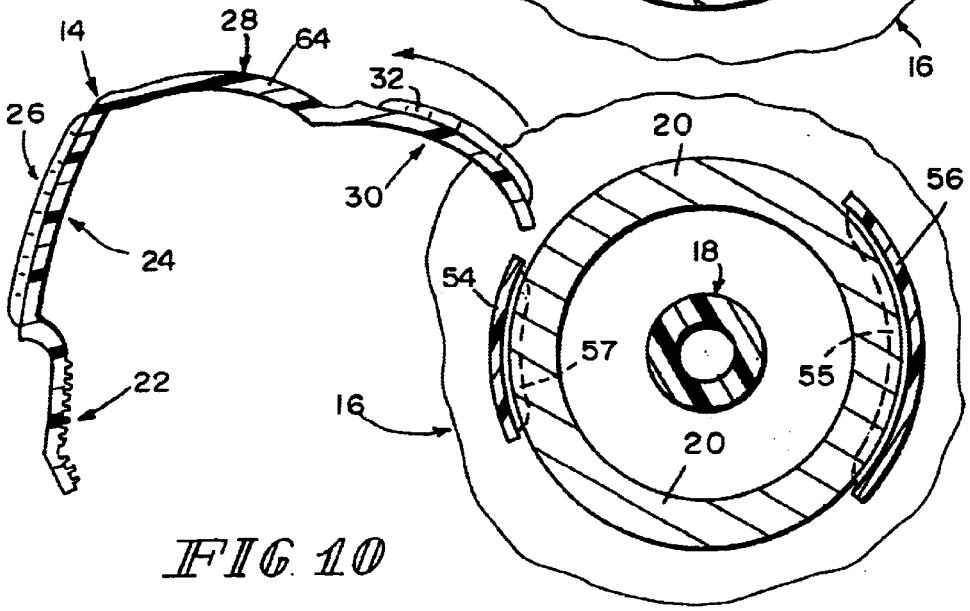

To remove overcap 10 from can 16 for the first time, annular tear strip 14 must be separated from closure 12 as shown, for example, in FIGS. 8–10. As shown, for example, in FIGS. 1–3, tear strip 14 includes, in series, a pull tab 22, a first arcuate section 24 carrying a first (temporary) retainer flange 26, a tether section 28, and a second arcuate section 30 carrying a second (temporary) retainer flange 32.

Figure 5:
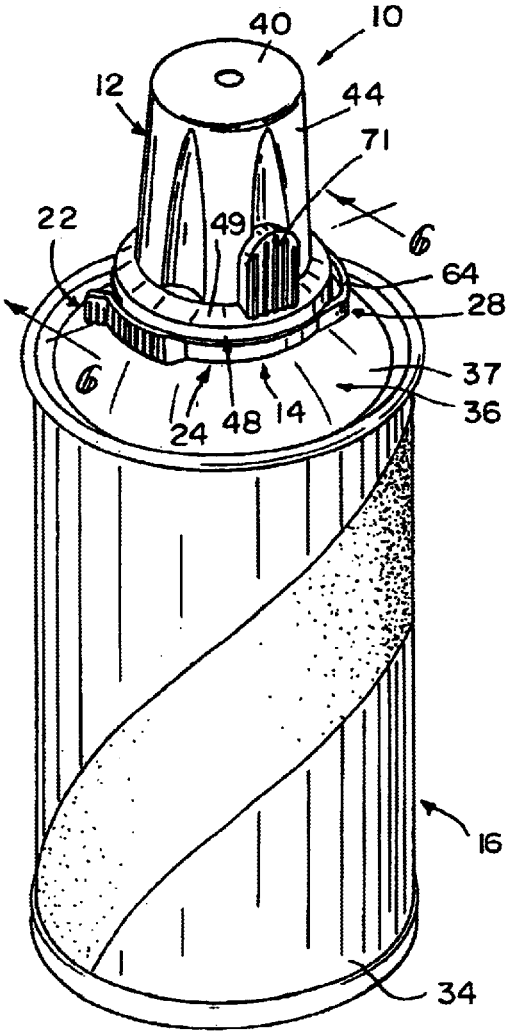
FIG. 5 is a perspective view of the tamper-evident overcap of FIGS. 1–3 mounted on an aerosol can.
Figure 6:
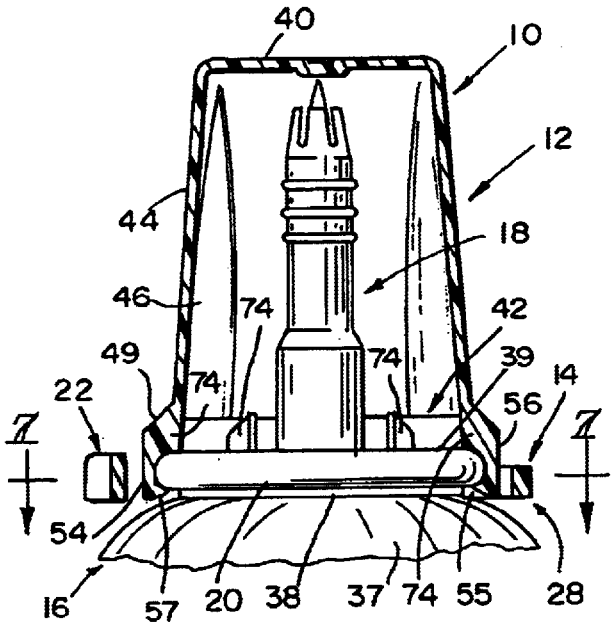
FIG. 6 is a sectional view of the overcap of FIG. 4 taken along line 6—6 of FIG. 5 showing engagement of portions of the closure and the annular tear strip with an annular lip of the aerosol can when the overcap is mounted on the aerosol can in a tamper-evident mounted position.

Can 16 is a well-known conventional design and includes a cylindrical body 34 and a closure member 36 mounted on body 34 to cover a top opening formed in body 34 as shown in FIG. 5. Closure member 36 is formed to include a dome 37 and annular lip 20 is located on dome 37 to surround dispenser valve 18. As shown, for example, in FIG. 6, overcap 10 covers dispenser valve 18 and engages an underside 38 of annular lip 20 when mounted on can 16.

As shown in FIGS. 1–3, closure 12 includes a circular top 40, an annular base 42, and an annular, frustoconical side 44 extending downwardly from top 40 to base 42. Side 44 is formed to include decorative scalloped regions 46 extending from base 42 upwardly toward top 40.

Base 42 of closure 12 includes a cylindrical wall 48 and an inclined annular wall 49 interconnecting cylindrical wall 48 and side 44 as shown best in FIG. 1. As suggested in FIG. 4, cylindrical wall 48 of base 42 includes a first annular band 51 coupled to inclined annular wall 49 and a second annular band 52. Second annular band 52 includes first and second arcuate sections 24, 30 of tear strip 14.

As suggested in FIG. 3, base 42 includes a first curved wall 54 next to pull tab 22 and a second curved wall 56 next to tether section 28. A third retainer flange 55 is cantilevered or otherwise coupled to an inwardly facing surface of second curved wall 56 and a fourth retainer flange 57 is cantilevered or otherwise coupled to an inwardly facing surface of first curved wall 54 as suggested in FIGS. 3 and 4.

Figure 11:
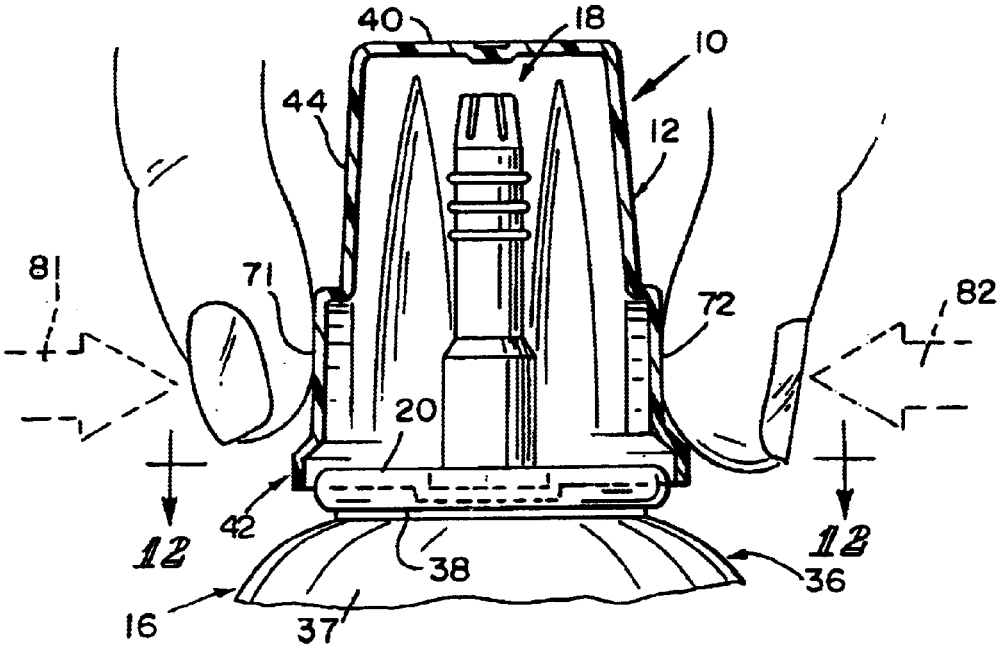
FIG. 11 is a sectional view of the overcap mounted on the aerosol can in the position shown in FIG. 10 (after separation of the tear strip from the closure base) showing a user pushing a pair of squeeze-removal pads on the side of the closure together to cause the third and fourth retainer flanges to disengage the annular lip of the aerosol can.
Figure 12:
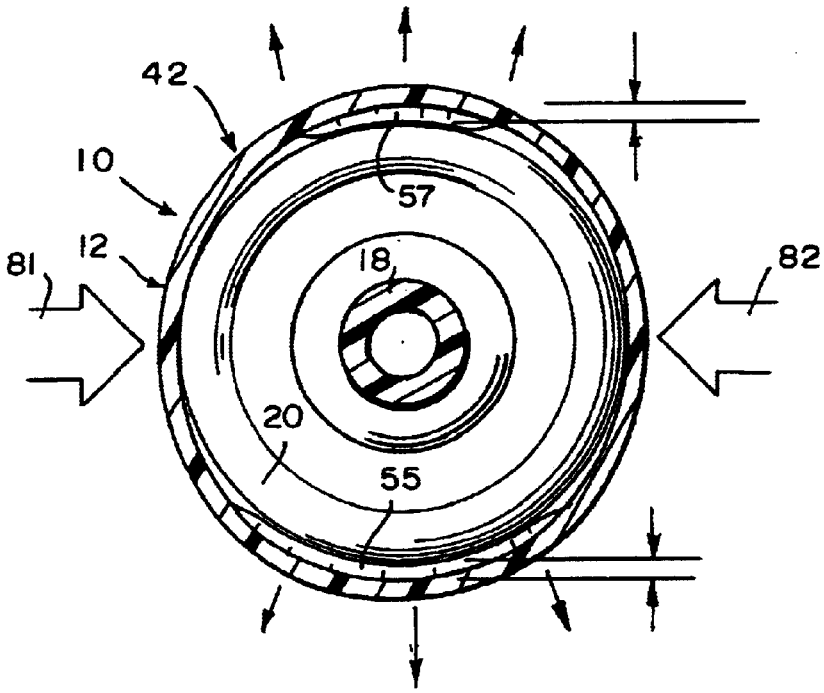
FIG. 12 is a sectional view taken along line 12—12 of FIG. 11.

The third and fourth retainer flanges 55, 57 are said to be "permanent" retainer flanges because they remain with closure 12 after separation of tear strip 14 from closure 12 as shown, for example, in FIGS. 10–12. First and second retainer flanges 26, 32 are said to be "temporary" retainer flanges because they do not remain with closure 12 after separation of tear strip 14 from closure 12 as suggested in FIGS. 10–12. Before tear strip 14 is separated from closure 12, each of the first, second, third, and fourth retainer flanges 26, 32, 55, 57 is adapted to engage the underside 38 of annular lip 20 to retain overcap 10 in a mounted position on can 16 as suggested in FIGS. 5 and 7.

Figure 7:
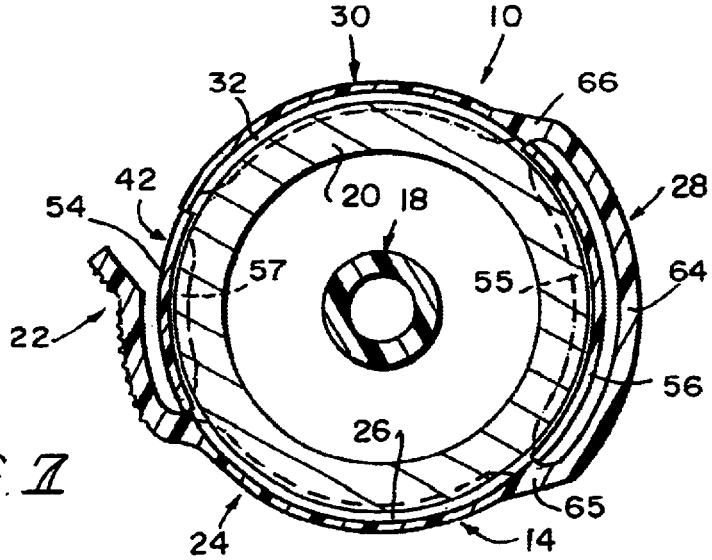
FIG. 7 is a sectional view of the overcap and portions of the aerosol can taken along line 7—7 of FIG. 6 showing that the annular tear strip includes, in series (in a counterclockwise direction beginning at 9:00 o'clock), a pull tab, a first arcuate section carrying a first retainer flange (in phantom), a tether section spaced from the base of the closure, and a second arcuate section carrying a second retainer flange (in phantom) and showing that the base of the closure includes a third retainer flange (in phantom) located between the first and second retainer flanges and near the tether section and a fourth retainer flange (in phantom) located between the second and first retainer flanges and near the pull tab, wherein each of the four retainer flanges engages the underside of the annular lip to retain the overcap in the tamper-evident mounted position on the aerosol can until the annular tear strip is separated from the base of the closure.

As suggested in FIGS. 2, 3, and 7, each of first band 51, first curved wall 54, and second curved wall 56 has a first thickness and each of first and second arcuate sections 24, 30 has a second thickness that is less than the first thickness. First curved wall 54 has an arc length and fourth retainer flange 57 is curved and has an arc length that is less than the arc length of first curved wall 54 as shown in FIG. 7. Second curved wall 56 has an arc length and third retainer flange 55 is curved and has an arc length that is less than the arc length of second curved wall 56 as shown in FIG. 7.

Figure 4:
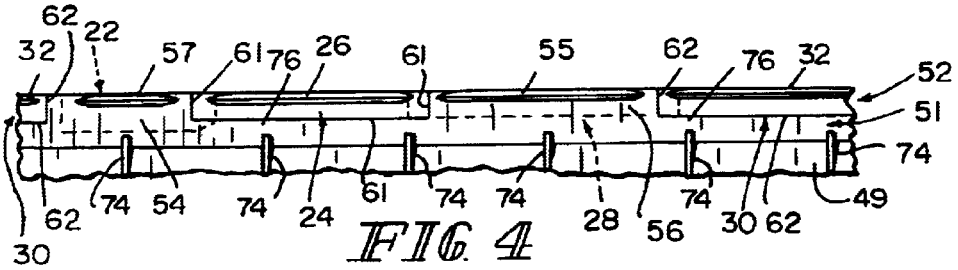
FIG. 4 is a "flat development" of an inwardly facing surface of a cylindrical side wall of the base of the closure and portions of the annular tear strip (from the inverted perspective shown in FIG. 2) before the tear strip is separated from the base of the closure showing a first band appended to six spaced stacking ribs and a second band connecting to the first band and carrying four retainer flanges and comprising (in series from left to right) a first curved wall (of the base), the first arcuate section (of the tear strip), a second curved wall (of the base), and a second arcuate section (of the tear strip)

As shown best in FIG. 4, a first frangible tear line 61 is established along a boundary between first arcuate section 24 and adjacent portions of first and second curved walls 54, 56 and first band 51. A second frangible tear line 62 is established along a boundary between second arcuate section 30 and adjacent portions of first and second curved walls 54, 56 and first band 51. In the illustrated embodiment, each of first and second frangible tear lines 61 and 62 is U-shaped.

Tether section 28 includes a curved rail 64 arranged to lie in spaced-apart relation to an exterior surface of second curved wall 56 as shown in FIGS. 3 and 7. Tether section 28 also includes a first rail mount 65 coupled to first arcuate section 24 and a first end of curved rail 64 and a second rail mount 66 coupled to second arcuate section 30 and a second end of curved rail 64. Tether section 28 functions to interconnect one end of first arcuate section 26 to one end of second arcuate section 30 to provide a "bypass" around one of the permanent retainer flanges (e.g., third retainer flange 55) of overcap 10. The exterior surface of second curved wall 56 is curved as shown, for example, in FIG. 3 to define a curved slot 67 between curved rail 64 and that curved exterior surface. Curved rail 64 has an arc length and the arc length of third retainer flange 55 is less than the arc length of curved rail 64 of tether section 28 as shown in FIG. 7.

Base 42 of closure 12 also includes a pair of frangible tab anchors 68 arranged to interconnect an outwardly facing surface of first curved wall 54 and an inwardly facing surface of pull tab 22 as suggested in FIGS. 2 and 3. These tab anchors 68 are "broken" as suggested in FIG. 8 upon movement of pull tab 22 in direction 69 to initiate separation of annular tear strip 14 from base 42 of closure 12. Otherwise, frangible tab anchors 68 function to retain pull tab 22 in a "ready" anchored position alongside closure 12 as shown in FIGS. 2 and 3. First curved wall 54 is arranged to lie normally in opposing spaced-apart relation to pull tab 22 as shown in FIG. 3.

Referring now to FIGS. 3, 4, and 7, annular tear strip 14 is shown to include, in series, pull tab 22, first arcuate section 24, tether section 28, and second arcuate section 30. During removal of tear strip 14, pull tab 22 is moved in direction 69 to (1) separate first arcuate section 24 from first and second curved walls 54, 56 and first band 51 along first frangible tear line 61 and (2) separate second arcuate section 30 from first and second curved walls 54, 56 and first band 51 along second frangible tear line 62 as suggested in FIGS. 7–10 without disturbing mating engagement of third and fourth retainer flanges 55, 57 and annular lip 20 of can 16. As shown in FIG. 10, the arc length of third retainer flange 55 is greater than the arc length of fourth retainer flange 57. These flanges 55, 57 cooperate to retain overcap 10 in a mounted position on can 16 to accommodate repeated mounting and dismounting of overcap 10 after separation of tear strip 14 from closure 12.

The procedure for dismounting overcap 10 from its mounted position on can 16 is illustrated in FIGS. 11 and 12. A first squeeze-removal pad 71 is provided on one portion of side 44 of closure 12 above base 42 and first arcuate section 24. A second squeeze-removal pad 72 is provided on another portion of side 44 of closure 12 above base 42 and second arcuate section 30. First and second squeeze-removal pads 71, 72 are located in spaced-apart relation to one another and cooperate to provide means for temporarily deforming side 44 to move first and second curved walls 54, 56 away from one another to cause third and fourth retainer flanges 55, 57 to disengage annular lip 20 while overcap 10 is mounted on can 16 and after separation of tear strip 14 from base 42 of closure 12 in response to movement of first squeeze-removal pad 71 toward second squeeze-removal pad 72 resulting from application of opposing forces 81, 82 to pads 71, 72 as shown in FIGS. 11 and 12 so that overcap 10 can be removed from a mounted position on annular lip 20 of can 16.

A plurality of stacking ribs 74 are coupled to first band 51 and inclined annular wall 49 as suggested in FIGS. 2–4 and adapted to engage a top side 39 (see FIG. 6) of annular lip 20 prior to and after separation of tear strip 14 from base 42 of closure 12 along first and second frangible tear lines 61, 62. Each stacking rib 74 includes a lip-engaging surface 76 arranged to lie in spaced-apart opposing relation to one of the four retainer flanges 26, 32, 55, 57 as shown in FIG. 4. The stacking ribs 74 are arranged to "bottom out" on annular lip 20 of can 16 as suggested in FIG. 6 to provide "top load" strength for overcap 10. Top load strength is needed once cans 16 are packed in corrugated cases. As such cases are palletized on a skid, the lower cases will be placed under top load. The corrugated cases may compress and come in contact with overcaps 10 and stacking ribs 74 function to resist such compression and support high stacking loads on the top of overcap 10.

Tear strip 14 is configured to separate from base 42 of closure 12 as one continuous strip so as to "separate" the temporary first and second retainer flanges 26, 32 from closure 12 without separating the permanent third and fourth retainer flanges 55, 57 from closure 12. Tether section 28 ties first and second arcuate sections 24, 30 together and bypasses second curved wall 56 carrying third retainer flange 55 to facilitate that result to provide for multi-use/removal of overcap 10.

Tear strip 14 provides two temporary retainer flanges 26, 32 that cooperate with the two permanent retainer flanges 55, 57 to provide 300° of flange retention capacity prior to separation of tear strip 14 from closure 12. After removal of tear strip 14, the two permanent retainer flanges 55, 57 cooperate to provide about 135° of flange retention capacity for overcap 10 on can 16.

What is claimed is:

1. A tamper-evident overcap for use on a can having a dispenser valve and an annular lip surrounding the dispenser valve, the overcap comprising a closure including a top, a base, and a side extending downwardly from the top to the base, and an annular tear strip appended to the base of the closure along separate first and second frangible tear lines, the tear strip including a first arcuate section connecting to the base of the closure along the first frangible tear line and carrying a first retainer flange removable from the closure and adapted to engage an underside of the annular lip, a pull tab coupled to the first arcuate section, a second arcuate section connecting to the base of the closure along the second frangible tear line and carrying a second retainer flange removable from the closure and adapted to engage the underside of the annular lip, a tether section spaced from the base of the closure and arranged to interconnect the first and second retainer flanges, and a third section connecting to the base of the closure and carrying a third retainer flange non-removable from the closure and adapted to engage an underside of the annular lip.

2. The overcap of claim 1, wherein the tether section includes a curved rail arranged to lie in spaced-apart relation to an exterior surface of the base of the closure, a first rail mount coupled to the first arcuate section and a first end of the curved rail, and a second rail mount coupled to the second arcuate section and a second end of the curved rail.

3. The overcap of claim 2, wherein the exterior surface is curved to define a curved slot between the curved rail and the exterior surface.

4. A tamper-evident overcap for use on a can having a dispenser valve and an annular lip surrounding the dispenser valve, the overcap comprising a closure including a top, a base, and a side extending downwardly from the top to the base, and an annular tear strip appended to the base of the closure along separate first and second frangible tear lines, the tear strip including a first arcuate section connecting to the base of the closure along the first frangible tear line and carrying a first retainer flange adapted to engage an underside of the annular lip, a pull tab coupled to the first arcuate section, a second arcuate section connecting to the base of the closure along the second frangible tear line and carrying a second retainer flange adapted to engage the underside of the annular lip, a tether section spaced from the base of the closure and arranged to interconnect the first and second retainer flanges, wherein the tether section includes a curved rail arranged to lie in spaced-apart relation to an exterior surface of the base of the closure, a first rail mount coupled to the first arcuate section and a first end of the curved rail, and a second rail mount coupled to the second arcuate section and a second end of the curved rail, and wherein the base of the closure includes a curved wall providing the exterior surface and including an inwardly facing interior surface and the base of the closure further includes a third retainer flange appended to the inwardly facing surface and adapted to engage the underside of the annular lip prior to and after separation of the tear strip from the base of the closure along the first and second frangible lines.

5. The overcap of claim 4, wherein the base of the closure includes a cylindrical band coupled to the first arcuate section along a portion of the first frangible tear line and to the second arcuate section along a portion of the second-frangible tear line, the curved wall is cantilevered to the cylindrical band and coupled to one end of the first arcuate section along another portion of the first frangible tear line and to one end of the second arcuate section along another portion of the second frangible tear line.

6. The overcap of claim 4, wherein the curved rail has an arc length and the third retainer flange is curved and has an arc length that is less than the arc length of the curved rail of the tether section.

7. A tamper-evident overcap for use on a can having a dispenser valve and an annular lip surrounding the dispenser valve, the overcap comprising a closure including a top, a base, and a side extending downwardly from the top to the base, and an annular tear strip appended to the base of the closure along separate first and second frangible tear lines, the tear strip including a first arcuate section connecting to the base of the closure along the first frangible tear line and carrying a first retainer flange adapted to engage an underside of the annular lip, a pull tab coupled to the first arcuate section, a second arcuate section connecting to the base of the closure along the second frangible tear line and carrying a second retainer flange adapted to engage the underside of the annular lip, a tether section spaced from the base of the closure and arranged to interconnect the first and second retainer flanges, wherein the base of the closure includes a third retainer flange adapted to engage the underside of the annular lip prior to and after separation of the tear strip from the base of the closure along the first and second frangible tear lines.

8. The overcap of claim 7, wherein the base of the closure includes a first band coupled to the first and second arcuate sections and adapted to surround the annular lip when the overcap is mounted on the can, a first curved wall cantilevered to the first band, a second curved wall cantilevered to the first band and arranged to lie in spaced-apart relation to the first curved wall, the third retainer flange is coupled to one of the first and second curved walls, the base of the closure further includes a second band appended to the first band and formed to include, in series, the first curved wall, the first arcuate section, the second curved wall, and the second arcuate section, the first frangible tear line is established along a boundary between the first arcuate section and a second end of the first curved wall, the first band, and a first end of the second curved wall, and the second frangible tear line is established along a boundary between the second arcuate section and a second end of the second curved wall and a first end of the first curved wall.

9. The overcap of claim 8, wherein the third retainer flange is coupled to the second curved wall and wherein the base of the closure further includes a fourth retainer flange that is coupled to the first curved wall and adapted to engage the underside of the annular lip prior to and after separation of the tear strip from the base of the closure along the first and second frangible tear lines.

10. The overcap of claim 8, wherein each of the first and second curved walls has a first thickness and each of the first and second arcuate sections has a second thickness that is less than the first thickness.

11. The overcap of claim 8, wherein each of the first band, first curved wall, and second curved wall has a first thickness and each of the first and second arcuate sections has a second thickness that is less than the first thickness.

12. The overcap of claim 8, further comprising a plurality of stacking ribs coupled to the first band to lie in spaced-apart opposing relation to the first, second, and third retainer flanges and adapted to engage a top side of the annular lip prior to and after separation of the tear strip from the base of the closure along the first and second frangible tear lines.

13. The overcap of claim 8, wherein the third retainer flange is coupled to the second curved wall and wherein the base of the closure further includes a fourth retainer flange that is coupled to the first curved wall and adapted to engage the underside of the annular lip prior to and after separation of the tear strip from the base of the closure along the first and second frangible tear lines, and further comprising a first squeeze-removal pad provided on one portion of the side of the closure above the base and the first arcuate section and a second squeeze-removal pad provided on another portion of the side of the closure above the base and the second arcuate section and wherein the first and second squeeze-removal pads are located in spaced-apart relation to one another and cooperate to provide means for temporarily deforming the side to move the first and second curved walls of the base away from one another to cause the third and fourth retainer flanges to disengage the annular lip while the overcap is mounted on the can and after separation of the tear strip from the base of the closure in response to movement of the first squeeze-removal pad toward the second squeeze-removal pad so that the overcap can be removed from a mounted position on the annular lip of the can.

14. A tamper-evident overcap for use on a can having a dispenser valve and an annular lip surrounding the dispenser valve, the overcap comprising a closure including a top, a base, and a side extending downwardly from the top to the base, and an annular tear strip appended to the base of the closure along separate first and second frangible tear lines, the tear strip including a first arcuate section connecting to the base of the closure along the first frangible tear line and carrying a first retainer flange adapted to engage an underside of the annular lip, a pull tab coupled to the first arcuate section, a second arcuate section connecting to the base of the closure along the second frangible tear line and carrying a second retainer flange adapted to engage the underside of the annular lip, a tether section spaced from the base of the closure and arranged to interconnect the first and second retainer flanges, wherein the base of the closure includes separate third and fourth retainer flanges adapted to engage the underside of the annular lip prior to and after separation of the tear strip from the base of the closure along the first and second frangible tear lines.

15. The overcap of claim 14, wherein the fast arcuate section includes a first end coupled to the pull tab and a second end coupled to the tether section, the second arcuate section includes a first end coupled to the tether section and a second end forming a terminal end of the tear strip, the third retainer flange is positioned to lie in a space defined between the second end of the first arcuate section and the first end of the second arcuate section, and the fourth retainer flange is positioned to lie in a space defined between the first end of the first arcuate section and the second end of the second arcuate section.

16. The overcap of claim 15, wherein the base of the closure includes a first curved wall coupled to the fourth retainer flange and positioned to lie between the fourth retainer flange and the pull tab and in spaced-apart relation to the pull tab and at least one frangible tab anchor arranged to interconnect the first curved wall to the pull tab to bridge a gap between the first curved wall and the pull tab and configured to separate from the pull tab upon movement of the pull tab relative to the base of the closure.

17. The overcap of claim 15, wherein the base of the closure further includes a second curved wall coupled to the third retainer flange and positioned to lie between the third retainer flange and the tether section and in spaced-apart relation to the tether section.

18. The overcap of claim 14, wherein the base of the closure includes a first curved wall arranged to lie in opposing spaced-apart relation to the pull tab and the fourth retainer flange is cantilevered to an inwardly facing surface of the first curved wall.

19. The overcap of claim 18, wherein the first curved wall has an arc length and the fourth retainer flange is curved and has an arc length that is less than the arc length of the first curved wall.

20. The overcap of claim 18, wherein the base of the closure further includes at least one frangible tab anchor arranged to interconnect an outwardly facing surface of the first curved wall and an inwardly facing surface of the pull tab.

21. The overcap of claim 18, wherein the base of the closure further includes a second curved wall arranged to lie in opposing spaced-apart relation to the tether section and the third retainer flange is cantilevered to an inwardly facing surface of the second curved wall.

22. The overcap of claim 14, wherein the base of the closure includes a first curved wall arranged to lie in opposing spaced-apart relation to the pull tab and the fourth retainer flange is cantilevered to an inwardly facing surface of the first curved wall.

23. The overcap of claim 22, wherein the second curved wall has an arc length and the third retainer flange is curved and has an arc length that is less than the arc length of the second curved wall.

24. A tamper-evident overcap for use on a can having a dispenser valve and an annular lip surrounding the dispenser valve, the overcap comprising a closure, first retainer means for providing two permanent retainer flanges adapted to engage an underside of the annular lip to retain the closure in a mounted position on the can, the first retainer means being coupled to the closure to remain therewith, and a tear strip coupled to the closure along a frangible tear line, the tear strip including second retainer means for providing two temporary retainer flanges adapted to engage the underside of the annular lip and to cooperate with the two permanent retainer flanges to retain the closure in the mounted position on the can until the tear strip is separated from the closure to disengage the two temporary retainer flanges from the annular lip without disengaging the two permanent retainer flanges from the annular lip wherein the first retainer means includes a first wall coupled to the closure, a second wall coupled to the closure and arranged to lie in spaced-apart confronting relation to the first wall, a first of the two permanent retainer flanges is coupled to an inwardly facing surface of the first wall, and a second of the two permanent retainer flanges is coupled to an inwardly facing surface of the second wall to extend in a direction toward the first of the two permanent retainer flanges wherein the first wall is curved and has an arc length and the second wall is curved and has an arc length less than the arc length of the first wall, and wherein the tear strip includes a pull tab arranged to lie in spaced-apart relation to the first of the permanent retainer flanges to position the first wall therebetween and a tether section arranged to lie in spaced-apart relation to an exterior surface of the second wall to define a slot therebetween and in spaced-apart relation to the second of the two permanent flanges to position the second wall therebetween, the second retainer means includes a first arcuate section lying in one space between the first and second walls and interconnecting the pull tab and one end of the tether section and carrying a first of the two temporary retainer flanges and a second arcuate section lying in another space between the first and second walls and connecting to another end of the tether section, and the frangible tear line is established along a boundary between the first arcuate section and the closure and along a boundary between the second arcuate section and the closure.

25. A tamper-evident overcap for use on a can having a dispenser valve and an annular lip surrounding the dispenser valve, the overcap comprising a closure, first retainer means for providing two permanent retainer flanges adapted to engage an underside of the annular lip to retain the closure in a mounted position on the can, the first retainer means being coupled to the closure to remain therewith, and a tear strip coupled to the closure along a frangible tear line, the tear strip including second retainer means for providing two temporary retainer flanges adapted to engage the underside of the annular lip and to cooperate with the two permanent retainer flanges to retain the closure in the mounted position on the can until the tear strip is separated from the closure to disengage the two temporary retainer flanges from the annular lip without disengaging the two permanent retainer flanges from the annular lip wherein the second retainer means includes a first arcuate section coupled to the closure along a portion of the frangible tear line and a second arcuate section coupled to the closure along another portion of the frangible tear line and arranged to lie in spaced-apart confronting relation to the first arcuate section, a first of the two temporary retainer flanges is coupled to an inwardly facing surface of the first arcuate section, and a second of the two temporary retainer flanges is coupled to an inwardly facing surface of the second arcuate section to extend in a direction toward the first of the two temporary retainer flanges, and wherein the tear strip further includes a pull tab coupled to the first arcuate section and arranged to lie in close proximity to a first of the permanent retainer flanges and a tether section coupled to the first and second arcuate sections and arranged to lie in spaced-apart relation to the second of the permanent retainer flanges to define a slot therebetween.

26. A tamper-evident overcap for use on a can having a dispenser valve and an annular lip surrounding the dispenser valve, the overcap comprising a closure, first retainer means for providing two permanent retainer flanges adapted to engage an underside of the annular lip to retain the closure in a mounted position on the can, the first retainer means being coupled to the closure to remain therewith, and a tear ship coupled to the closure along a frangible tear line, the tear strip including second retainer means for providing two temporary retainer flanges adapted to engage the underside of the annular lip and to cooperate with the two permanent retainer flanges to retain the closure in the mounted position on the can until the tear strip is separated from the closure to disengage the two temporary retainer flanges from the annular lip without disengaging the two permanent retainer flanges from the annular lip wherein the closure includes a base coupled to the second retainer means along the frangible tear line and to the first retainer means, the base includes an inclined annular wall and a cylindrical band arranged to interconnect the inclined annular wall and the first and second retainer means, and further comprising a plurality of circumferentially spaced-apart stacking ribs coupled to the inclined annular wall and to the cylindrical band and adapted to engage a top side of the annular lip prior to and after separation of the tear strip from the base of the closure along the frangible tear line.

27. A tamper-evident overcap for use on a can having a dispenser valve and an annular lip surrounding the dispenser valve, the overcap comprising a closure, first retainer means for providing two permanent retainer flanges adapted to engage an underside of the annular lip to retain the closure in a mounted position on the can, the first retainer means being coupled to the closure to remain therewith, and a tear strip coupled to the closure alone a frangible tear line, the tear strip including second retainer means for providing two temporary retainer flanges adapted to engage the underside of the annular lip and to cooperate with the two permanent retainer flanges to retain the closure in the mounted position on the can until the tear strip is separated from the closure to disengage the two temporary retainer flanges from the annular lip without disengage the two permanent retainer flanges from the annular lip further comprising first and second squeeze-removal pads arranged in opposing relation to one another on the closure to provide means for temporarily deforming the closure to move the two permanent retainer flanges away from one another to disengage the annular lip while the overcap is mounted on the can and after separation of the tear strip from the closure in response to movement of the first squeeze-removal pad toward the second squeeze-removal pad so that the overcap can be removed from a mounted position on the annular lip of the can.

28. A tamper-evident overcap for use on a can having a dispenser valve and an annular lip surrounding the dispenser valve, the overcap comprising a closure including a top, a base, and a side extending downwardly from the top to the base, the base including a first annular band and a second annular band coupled to the first annular band, the second annular band including, in series, a first curved wall connecting to the first annular band and carrying a fourth retainer flange adapted to engage an underside of the annular lip, a first arcuate section connecting to the first annular band and to the first curved wall along a first frangible tear line and carrying a first retainer flange adapted to engage the underside of the annular lip, a second curved wall connecting to the first annular band and to the first arcuate section along the first frangible tear line and carrying a third retainer flange adapted to engage the underside of the annular lip, and a second arcuate section connecting to the first and second curved walls and to the first annular band along a second frangible tear line separate from the first frangible tear line and carrying a second retainer flange adapted to engage the underside of the annular lip, a pull tab coupled to the first arcuate section, and a tether section coupled to each of the first and second arcuate sections, the pull tab, first arcuate section, tether section, and second arcuate section cooperating to define a tear strip configured to be separated from the closure along the first and second frangible tear lines.

* * * * *